United States Patent [19]

Klages et al.

[11] Patent Number: 4,584,463

[45] Date of Patent: Apr. 22, 1986

[54] ELECTRIC CONTINUOUS FLOW HEATER

[75] Inventors: Horst Klages, Holzminden; Hartmut Bonatz, Eschershausen; Ernst Appun; Klaus-Dieter Wahnschaffe, both of Holzminden; Baldur Friedrich, Bevern; Karl H. Jakal, Höxter-Stahle, all of Fed. Rep. of Germany

[73] Assignee: Stiebel Eltron GmbH & Co. KG, Holzminden, Fed. Rep. of Germany

[21] Appl. No.: 533,106

[22] Filed: Sep. 19, 1983

[30] Foreign Application Priority Data

Sep. 25, 1982 [DE] Fed. Rep. of Germany ..... 3235636
Jun. 27, 1983 [DE] Fed. Rep. of Germany ..... 3323058

[51] Int. Cl.[4] ..... H05B 1/02; H05B 3/82; F24H 1/10

[52] U.S. Cl. ..... 219/306; 219/309; 219/314; 219/320

[58] Field of Search ..... 219/296–299, 219/306–309, 312, 314, 316, 318, 320, 321

[56] References Cited

U.S. PATENT DOCUMENTS 1,451,671 4/1923 Cartter et al. ..... 219/316

FOREIGN PATENT DOCUMENTS 1057312 5/1959 Fed. Rep. of Germany ..... 219/314
3218863 11/1983 Fed. Rep. of Germany ..... 219/306
132031 8/1978 German Democratic Rep. ..... 219/312
2037958 7/1980 United Kingdom ..... 219/314
892141 12/1981 U.S.S.R. ..... 219/306

*Primary Examiner*—A. Bartis
*Attorney, Agent, or Firm*—Abelman Frayne Rezac & Schwab

[57] ABSTRACT

A continuous-flow water heater has an elongated closed tank with sidewalls and end closures. The tank is arranged with its longitudinal axis substantially vertical and is provided with a vertically disposed internal tubular baffle dividing the tank into inner and outer concentric compartments which are open to each other at the top and bottom of the tank. A plurality of electric immersion heating elements are positioned within the inner compartment and extend substantially parallel to the longitudinal axis of the baffle. A jet nozzle extends into the bottom of the tank and is arranged to direct a substantially vertically directed high velocity jet of water into the tubular baffle and toward the top end closure of the tank. The water jet traverses the heating elements and produces a continuous vertical recirculatory flow of water within the tank upwardly through the inner compartment and downwardly through the outer compartment thereby diminishing steam bubble formation, reducing noise, establishing a uniform temperature distribution in the tank and reducing the build-up of lime deposits. The heated water flows from the tank through an outlet in the top end closure. The jet nozzle may be a venturi nozzle having associated with the throat thereof a pressure responsive switch controlling energization of the heating elements. Flow directing members for inducing a helical flow of water through the inner chamber may be provided within the tubular baffle.

7 Claims, 11 Drawing Figures

ELECTRIC CONTINUOUS FLOW HEATER

FIELD OF THE INVENTION

This invention relates to a continuous-flow water heater of the type having a tank in which an eletrical heating unit is disposed, and to which are connected an inlet for the cold water to be heated and an outlet for heated water.

BACKGROUND OF THE INVENTION

It is proposed in West German Patent Application No. P 3218863.3 that a continuous-flow water heater be in the form of a vertical cylindrical tank containing a concentric array of electrical heating elements, and, that heated water be withdrawn from an upper end of the tank. In order to increase the rate of heat exchange between the heaters and the water to be heated, the water is caused to move within the tank in a cyclic path by introducing the water tangentially into the tank at positions spaced vertically of the tank. By so doing, the formation of steam bubbles in the tank is reduced, as is the mechanical noise produced by such steam bubbles.

SUMMARY OF THE INVENTION

It is an object of this invention to further increase the rate of heat transfer from the heating elements to the water, and, to further minimize the formation of steam bubbles, and, in consequence, to permit a reduction in size of the water heater for a given output rate of the heater.

This is accomplished in the heater of the present invention by inducing a forced recirculatory flow within the heater utilizing energy derived from the entering water flow in supplement to thermally induced convection flow within the heater.

According to the present invention, a continuous-flow water heater includes a tubular baffle within the tank and which separates a first compartment from a second compartment. The heating unit is located in the second compartment. The two compartments are open to each other at both of their ends. The water inlet opens into the second compartment at its lower end and is in the form of a vertically directed high velocity jet of water that induces a vertical recirculatory flow within the tank between the first and second compartments.

This assures, that the flow along the heating unit or units is increased to a maximum, resulting in diminshed steam bubble formation, and also in diminishing noise.

The enhanced water of ciruclation leads to a uniform temperature distribution in the tank. This permits making the volume of the tank small, thereby contributing to a compact construction of the continuous-flow heater.

Another advantage of the invention is that build up of lime deposits in the tank is greatly reduced.

In a preferred embodiment of the invention, the two compartments are open toward each other at the top and bottom, and the inlet discharges into the tank at the bottom. It is achieved thereby that the thermal convection caused by the heating unit, and the direction of flow deriving from the water in flow into the second compartment are codirectional.

DESCRIPTION OF THE DRAWINGS

The invention will now be described with reference to the accompanying drawings, which illustrate preferred embodiments of the invention, and in which.

DESCRIPTION OF THE PREFERRED EMBODIMENTS

An inlet 2 leads into a cylindrical tank 1 at the bottom thereof. At the top, an outlet 3 is connected to tank 1.

The inlet 2 lies approximately on the axis of the tank 1. Around the axis of the tank are grouped several electric heating units 4, which extend parallel to the axis of the tank.

Figure 1:
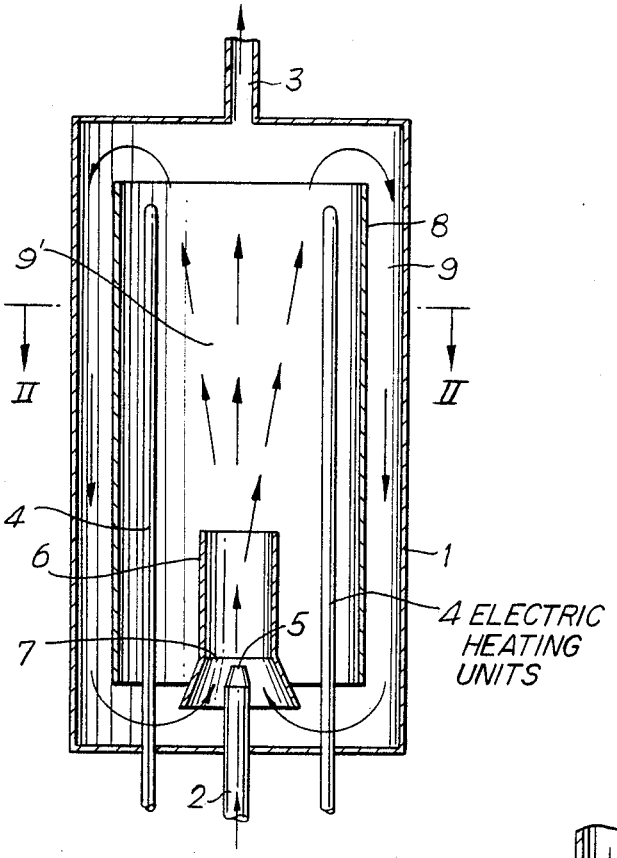
FIG. 1 shows a schematic sectional view of one embodiment of continuous-flow heater.
Figure 2:
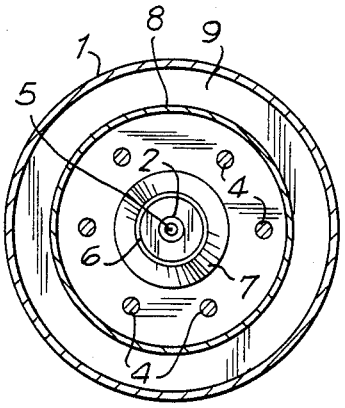
FIG. 2, a section along line II—II in FIG. 1.

In the embodiment according to FIG. 1, the inlet 2 is designed as a water jet pump, and includes an injector nozzle 5 and a diffusor tube 6. Located at the lower end of the diffusor tube 6 is a conical suction orifice 7.

A cylindrical baffle 8 is disposed between the heating units 4 and the tank 1, and forms a first compartment 9 of annular cross-section which is in open communication at its ends with a second compartment 9' interiorly of the baffle 8 and in which the heating units 4 are arranged.

In FIGS. 3 to 11, the inlet 2 is in the form of a venturi nozzle 10. To the latter is connected a differential pressure switch 11, which switches the heating units 4. The venturi nozzle 10 has a throat 12. When cold water flows through the venturi nozzle 10, a higher pressure builds up before the throat 12 and a lower pressure prevails in the region of the constriction 12. The switch 11 is switched by the pressure differential.

A diffuser 13 follows the throat 12, and corresponds in function to the injector nozzle 5 of FIG. 1. In the embodiments of FIGS. 3 to 11, the suction orifice 7 is provided by the spacing between the diffuser 13 and the lower edge of guide tube 8.

Figure 4:
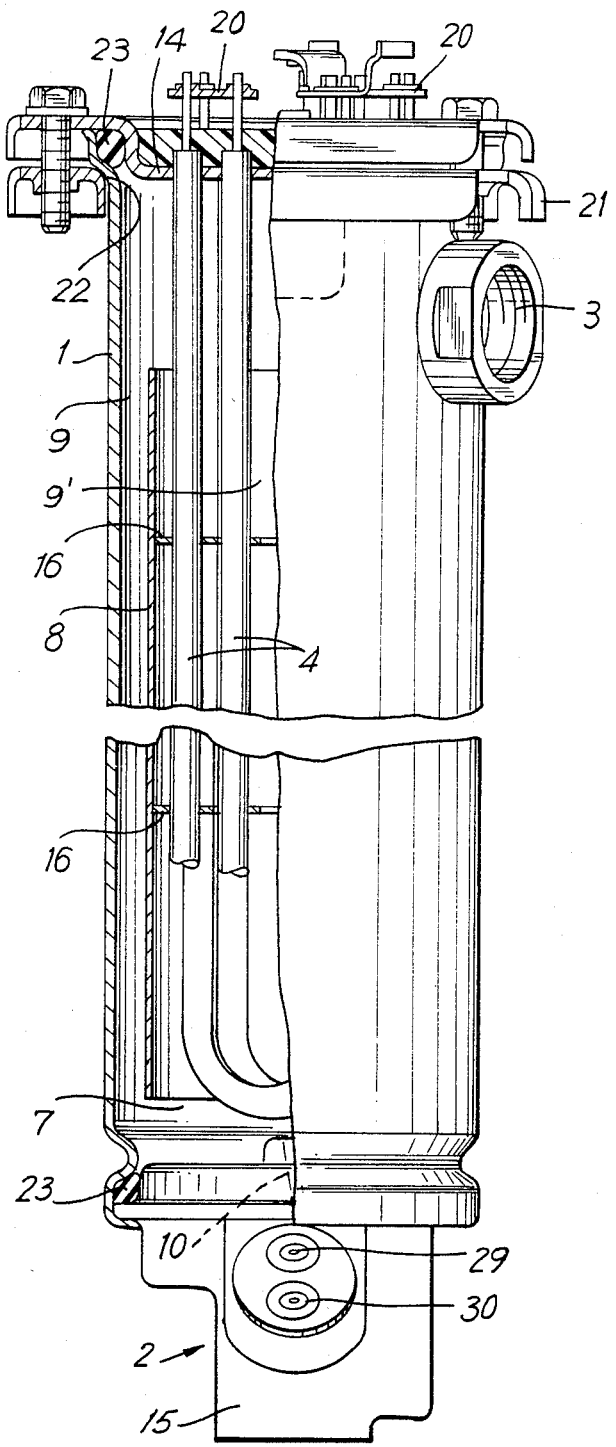
FIG. 4, a partial section of a preferred embodiment of continuous-flow heater.
Figure 9:
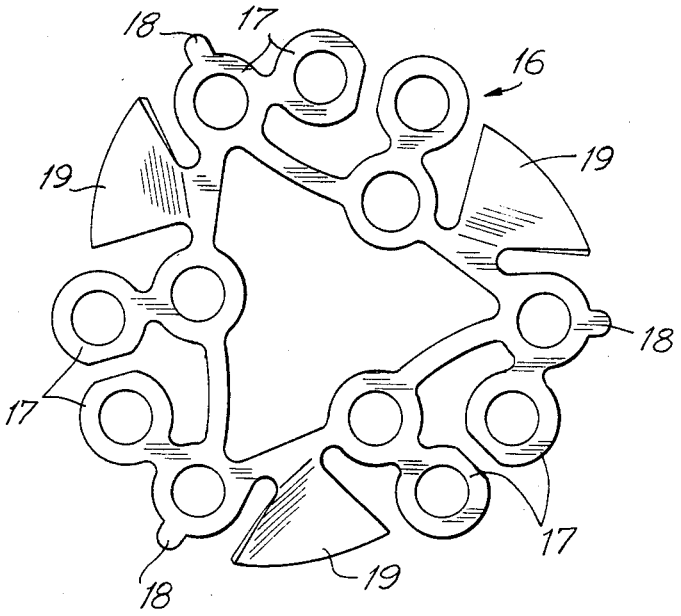
FIG. 9, shows a spacer for the heating units of FIG. 4.

As shown in FIG. 4, tank 1 is provided with an upper closure 14 and a lower closure 15. Supported by the upper closure 14 are U-shaped electric heating units 4. As shown in FIGS. 4 and 9, spacers 16 are supported on the heating units 4 by means of rings 17. The spacers 16 are provided with noses 18 which hold and support the guide tube 8. In addition, flow directing vanes 19 are provided on the spacers 16 to induce helical rotation of the water flow around the central axis.

Figure 5:
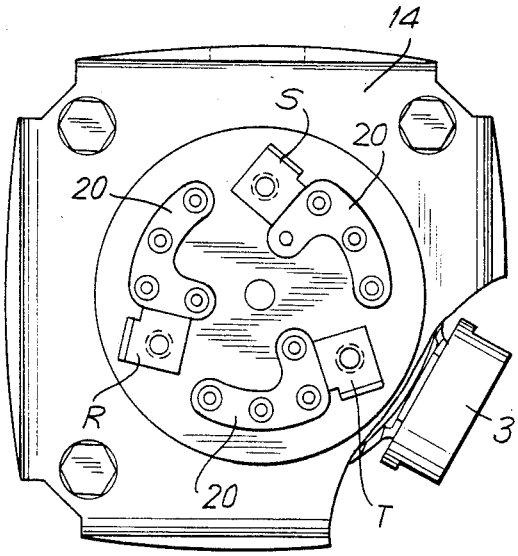
FIG. 5, a plan view of the heater of FIG. 4.
Figure 6:
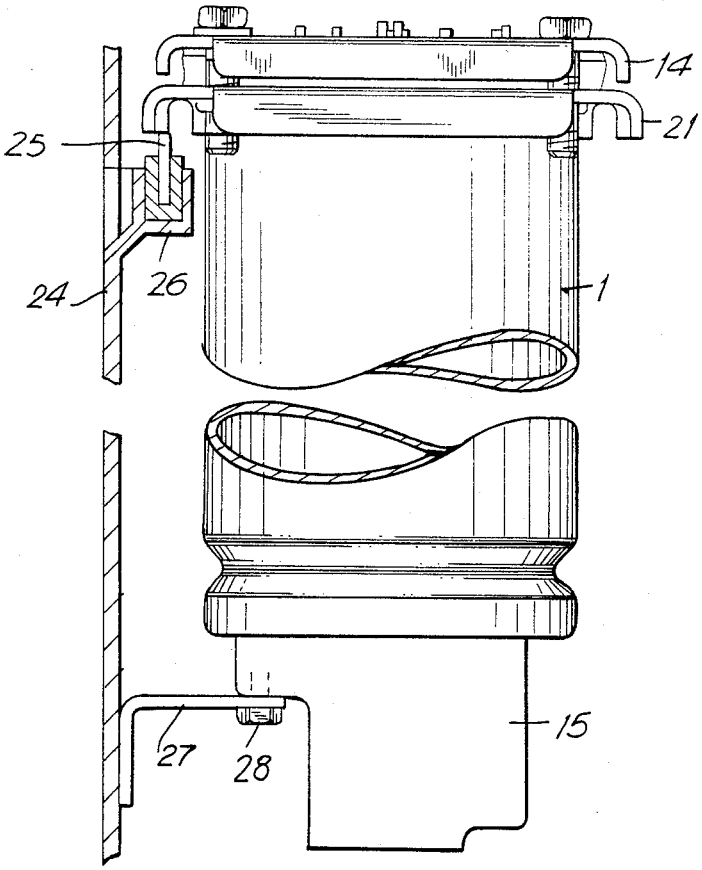
FIG. 6, illustrates a support for the heater of FIG. 4.
Figure 7:
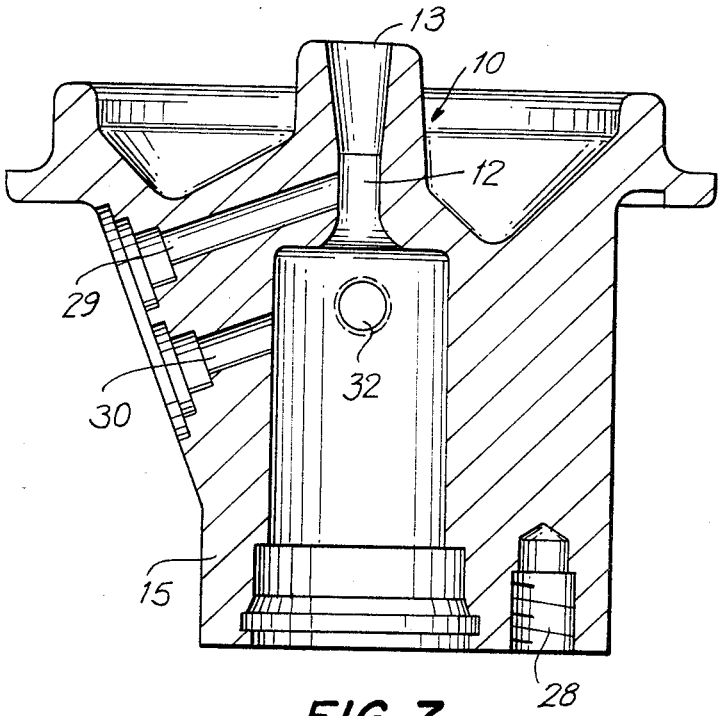
FIG. 7, shows a bottom flange of the tank of FIG. 4, in section.
Figure 8:
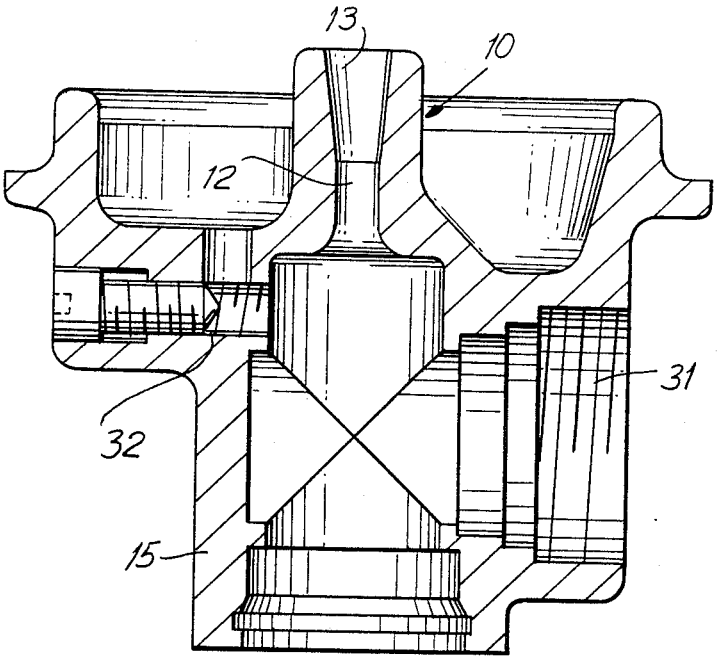
FIG. 8, shows the flange of FIG. 7 in a sectional plane perpendicular to FIG. 7.

As shown in FIGS. 4 and 5, heating units 4 are electrically delta-connected to poles R,S and T of a three-wire supply system by means of contact strips 20.

The upper closure 14 is secured to the tank top by use of a compression ring 21 which reacts against a shoulder 22 at the tank top. The shoulder internally supports a sealing ring 23.

Tank 1 is supported within a housing 24 by means of a lug 25 (FIG. 6) provided on the compression ring 21, and which is received within a seating 26 provided on a backwall of housing 24. The lower closure 15 is secured to the housing 24 by a bracket 27 attached to housing 24 and secured to the lower closure 15 by a bolt 28.

The lower closure 15, has bores 29 and 30 connection of the differential pressure switch 11. The cold water line is to be connected to a lateral port 31. An adjustable by-pass 32 permits adjustments of the pressure differential applied to the switch 11. By-pass 32 opens into the second compartment 9.

Figure 10:
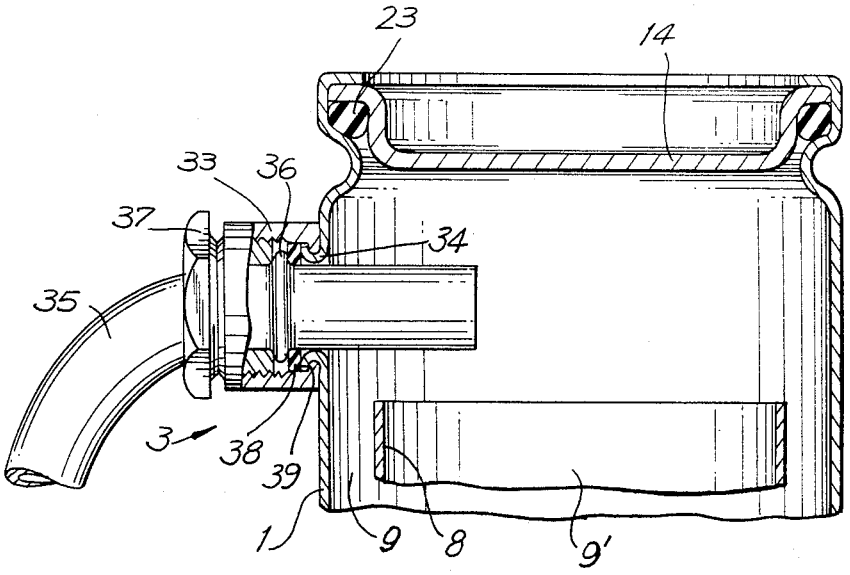
FIG. 10, shows an outlet of the heater of FIG. 4.
Figure 11:
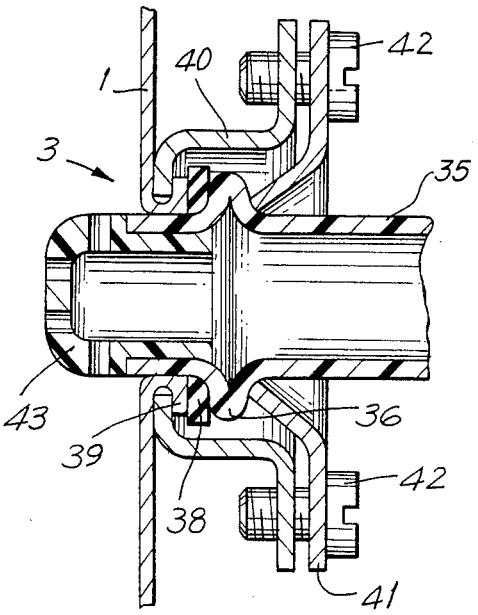
FIG. 11, shows an alternative to the outlet of FIG. 10.

As shown in FIGS. 4, 10 and 11, the outlet 3 is arranged on the side of tank 1 adjacent the top thereof. In FIG. 10, a threaded bushing 33 is secured about an opening 34 of tank 1 by means of a flange 39. An outlet pipe 35 has a bead 36 formed by upsetting. The latter is pressed into bushing 33 by a threaded collar 37 screwed into bushing 33 and seats on a sealing ring 38 reacting against the flange 39.

In FIG. 11, a first collar 40 is attached to the side of the tank 1 by means of a flange 39. An outlet pipe 35 has a bead 36 formed thereon by upsetting, and which is engaged by a second collar 41. The bead 36 is urged into seating engagement with a sealing ring 38 interposed between the bead 36 and the flange 39, by screws 42 which extend through the collar 41 and are threaded into the collar 40.

A perforated plastic insert 43 produces a back pressure in tank 1.

Figure 3:
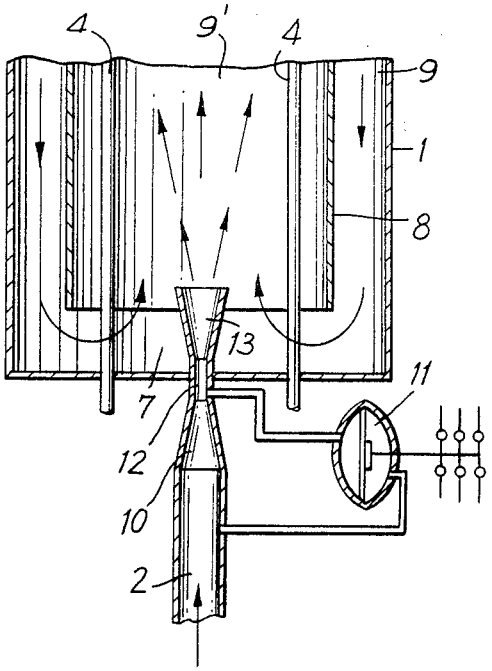
FIG. 3, a schematic sectional view of a further embodiment of continuous-flow heater.

The continous-flow water heater descibed operates as follows:

The direction of water flow within tank 1 is indicated by arrows in FIGS. 1 and 3. When cold water passes into tank 1 through inlet 2, a pressure drop occurs at the suction orifice 7. Water already in tank 1 is thereby entrained with the water injected through inlet 2. The temperature of the resulting mixed stream is thus intermediate the temperature of the injected cold water and that of the heated water drawn in through orifice 7 from the first compartment 9. The heating units 4 add further heat to the mixed stream. Owing to the high flow velocity of the mixed stream as well as the greater volume thereof as compared with the volume of water entering through inlet 2, steam bubble formation at the heating units 4 is reduced.

Part of the upwardly directed flow of heated water leaves tank 1 through outlet 3. The remainder continues by convection flow and is drawn into the compartment 9, where it is drawn downwardly towards the suction orifice 7. Hence the same volume of water traverses the heating units 4 several times.

In conventional continuous flow heaters, the volume of cold water entering through inlet 2 is the same as the relatively small volume of hot water leaving through outlet 3, and the flow past the heaters is relatively quiescent. The present invention provides for a greatly increased volumetric flow past the heating units 4, by virtue of the internally circulatory flow, this having the further advantage that lime or scale settling out at the bottom of tank 1 is automatically flushed out of the tank and cannot accumulate.

The volume of tank 1 is made sufficiently large enough so that residual heat in the heating units 4 does not result in boiling of the water after water flow has been turned off and the heating units thus de-energised.

Numerous modifications are within the scope of the invention. Thus it is possible, for example, to eliminate the diffuser tube 6 or to connect the diffusor tube 6 directly with the guide tube 8, so that the bottom of the annular space 9 merges directly into the suction orifice 7. It is not necessary to design the inlet 2 as an injector nozzle or venturi nozzle. The desired suction effect can be obtained also with a simple pipe end. Instead of the guide tube 8, a flat wall is sufficient provided that it creates in the tank 1 a compartment 9 remote from the heating units and through which preheated water can be returned to the lower end of the second compartment 9'.

Further it is possible to provide the guide tube 8 with appertures through which partial streams of water can circulate between the compartments 9 and 9'.

We claim:

1. A continuous-flow water heater, including:

an elongated closed tank having sidewalls and end closures, said tank being arranged with its longitudinal axis substantially vertical;

substantially vertical baffle means positioned within said tank;

means supporting said baffle means spaced from a vertical wall of said tank, and with respective upper and lower ends of said baffle spaced from top and bottom end closures of said tank and forming a pair of compartments communicating at their top and bottom;

electrical heating elements positioned at one side of said baffle means in one of said compartments, said heating elements extending substantially parallel to said baffle means;

a jet nozzle for the supply of water under pressure extending into a lower portion of said tank, and positioned with the axis of said jet nozzle at said one side of said baffle means, said jet nozzle being arranged to direct a substantially vertically directed high velocity jet of water into said one compartment and toward said top closure; and, water oulet means located at an upper end of said tank;

whereby water injected into said tank through said nozzle traverses said heating elements and produces a continuous recirculatory flow within said tank upwardly of said one side of said baffle means and downwardly between said baffle means and said vertical wall of said tank.

2. A continuous-flow water heater, including:

an elongated closed tank having a tubular wall arranged with its longitudinal axis substantially vertical;

top and bottom end closures respectively closing the top and bottom ends of said tubular wall;

tubular baffle means positioned within said tank with the axis of said baffle means positioned substantially vertically;

means supporting said tubular baffle means spaced from and substantially concentric with said tubular wall to define a pair of concentric compartments communicating at their upper and lower ends, and with respective upper and lower ends of said tubular baffle terminating spaced from said top and bottom end closures;

electrical heating elements positioned within said tubular baffle means, said heating elements each extending substantially parallel to the longitudinal axis of said tubular wall and said baffle means;

a jet nozzle for the supply water under pressure extending into a lower portion of said tank, and positioned with the axis of said jet nozzle substantially coaxial with said baffle means, said nozzle being arranged to direct a substantially vertically directed high velocity jet of water into the tubular baffle means and toward the top closure of the tank; and, water outlet means located at an upper end of said tank;

whereby water injected into said tank through said nozzle traverses said heating elements and produces a continuous recirculatory flow within said tank longitudinally and upwardly within said baffle means and longitudially and downwardly between said baffle means and said tubular wall.

3. The continuous-flow water heater of claim 2, including a flow directing tube concentric with said supply jet nozzle and spaced radially outwardly therefrom, said flow directing tube being spaced radially inwardly of said electrical heating elements and extending longitudinally and co-axially within said baffle means.

4. The continuous-flow water heater of claim 2, in which said supply jet nozzle is a velocity increasing jet nozzle.

5. The continuous-flow heater of claim 2, in which said supply jet nozzle is a venturi nozzle, further including a pressure responsive switch operatively connected to a throat of said nozzle for said switch to cose during passage of water through said throat, said switch being connected in electrical supply lines to said heating elements.

6. The continuous-flow water heater of claim 2, in which said means supporting said baffle means include perforate members secured to said electrical heating elements and to said baffle means at locations spaced axially thereof.

7. The continuous-flow water heater of claim 6, in which said support means further include flow directing members for inducing a helical flow of water axially within said baffle means.

* * * * *